US006554693B2

(12) United States Patent
Lee

(10) Patent No.: US 6,554,693 B2
(45) Date of Patent: Apr. 29, 2003

(54) WITHDRAWAL APPARATUS OF A COIN RECEIPT TUBE FOR A COIN SEPARATOR

(75) Inventor: Jongsuk Lee, Kyunggi-do (KR)

(73) Assignee: Royal Sovereign, Inc., Incheon (KR)

( * ) Notice: Subject to any disclaimer, the term of this patent is extended or adjusted under 35 U.S.C. 154(b) by 51 days.

(21) Appl. No.: 09/851,611

(22) Filed: May 9, 2001

(65) Prior Publication Data

US 2002/0168932 A1 Nov. 14, 2002

(51) Int. Cl.[7] ..... G07D 3/00
(52) U.S. Cl. ..... 453/14; 453/3; 453/61
(58) Field of Search ..... 453/3–5, 9, 14, 453/15, 61, 62

(56) References Cited

U.S. PATENT DOCUMENTS 34,202 A * 1/1862 Nottingham et al. ..... 222/466
34,203 A * 1/1862 Geib et al. ..... 374/160
4,102,110 A * 7/1978 Iizuka et al. ..... 453/61
5,011,457 A * 4/1991 Takatani et al. ..... 414/795

* cited by examiner

*Primary Examiner*—Kathy Matecki
*Assistant Examiner*—Sang Kim
(74) *Attorney, Agent, or Firm*—Roberts Abokhair & Mardula, LLC

(57) ABSTRACT

The present invention relates to a coin separator which sorts and separates coins according to size, particularly to a withdrawal apparatus of a coin receipt tube for a coin separator, wherein a sloping structure having a rail is built on the rear part of a fallen-coin drawer, a roller at the lower part of a receipt vessel is laid on the rail of the above sloping structure, and the receipt vessel containing a coin receipt tubes is pushed upward by the slanting structure which slides toward the front when the fallen-coin drawer is opened, whereby the above receipt tube is protruded to the outside of the coin separator so that the withdrawal of a coin receipt tube from the receipt vessel is facilitated.

3 Claims, 4 Drawing Sheets

Prior Art

WITHDRAWAL APPARATUS OF A COIN RECEIPT TUBE FOR A COIN SEPARATOR

FIELD OF THE INVENTION

The present device relates to a coin separator which sorts and separates coins according to size, particularly to a withdrawal apparatus of a coin receipt tube for a coin separator, wherein a sloping structure having a rail is built on the rear part of a fallen-coin drawer, a roller at the lower part of a receipt vessel is laid on the rail of the above sloping structure, and the receipt vessel containing the coin receipt tubes is pushed upward by the slanting structure which slides toward the front when the fallen-coin drawer is opened, whereby the above receipt tube is protruded to the outside of the coin separator so that the withdrawal of a coin receipt tube from the receipt vessel is facilitated.

BACKGROUND INFORMATION

The present invention relates to a coin separator, particularly to its withdrawal apparatus of a coin receipt tube, where the coin receipt tube moves up and down according to the forward and backward movement of the sloping structure that is of one piece with the fallen-coin drawer.

In financial institutions or on the scene of commercial dealings, the necessity to sort a large quantity of coins quickly and exactly according to size is on the increase.

The structure of a prior art coin separator which sorts and separates coins by size comprises is illustrated in FIG. 1 and includes: an input opening 1 into which coins are put; a coin separation valve 5 which sorts and separates free-fallen coins according to size by means of multiple separation holes 4 of different diameters; a carrier vessel 3 which has coin carrier holes 2 onto which coins are loaded, and carries inputted coins to the separation holes 4 of the coin separation valve 5; a receipt vessel 8 which contains many coin receipt tubes 7 which receive sorted and separated coins and can be mounted on and be removed from the receipt vessel 8; and a fallen-coin vessel 9 where coins which overflow the above coin receipt tubes 7 are collected.

The prior art coin separator of FIG. 1 has problems in that the coin receipt tube 7 should be installed inside the coin separator because coins sorted and separated at the separation holes 4 of the coin separation valve 5 are received by the coin receipt tubes 7 via the movement passage 6; and in that it is difficult to mount or remove the coin receipt tubes 7 on or from the receipt vessel 8 because the receipt vessel 8 is fixed to the inside of the separator to consequently collect coins received by the receipt tubes 7.

BRIEF SUMMARY OF THE INVENTION

The purpose of the present invention is to provide a withdrawal apparatus of a coin receipt tube for a coin separator, where the coin receipt tube is easily mounted on or removed from a receipt vessel because the receipt vessel is pushed upward by a sloping structure which slides when a fallen-coin drawer is opened and thus the coin receipt tube is projected out of the coin separator.

DETAILED DESCRIPTION OF THE INVENTION

The present device comprises: a sloping structure which is built at the rear part of a fallen-coin drawer which is of one piece with the structure, and has a rail on its upper part in the direction of the length; a receipt vessel whose roller touches the rail of the sloping structure; and coin receipt tubes which are mounted on the above receipt vessel.

Figure 1:
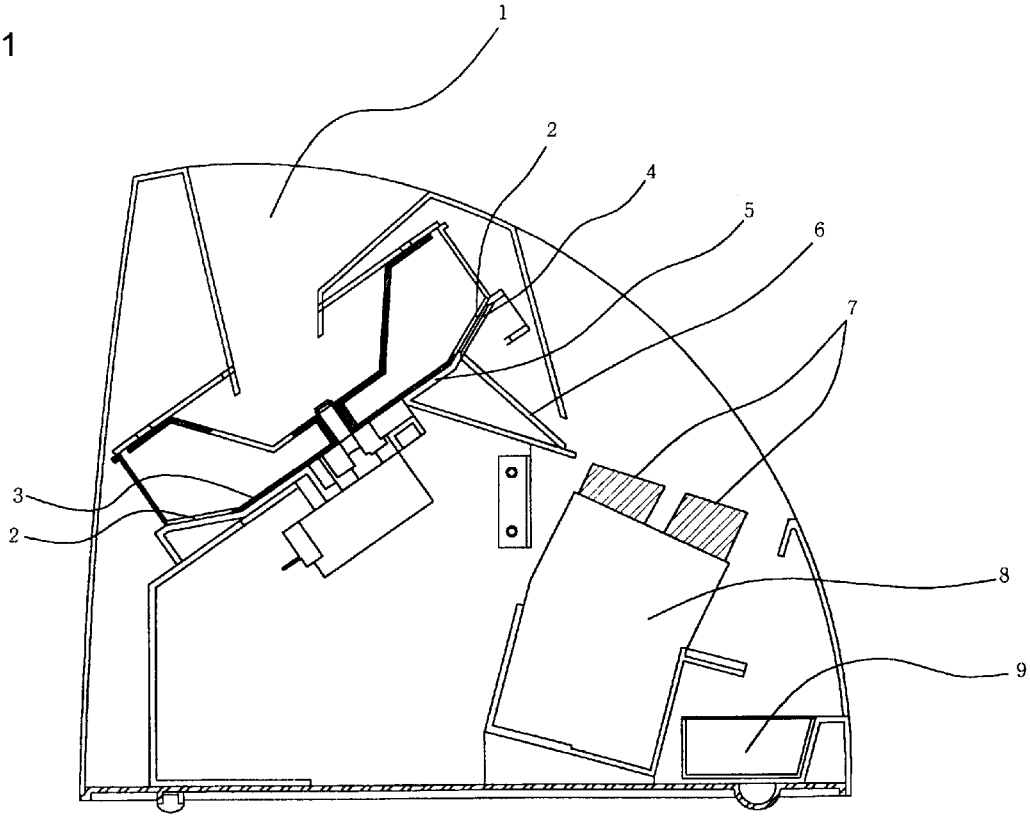
FIG. 1 is a schematic diagram of a prior art coin separator.
Figure 2:
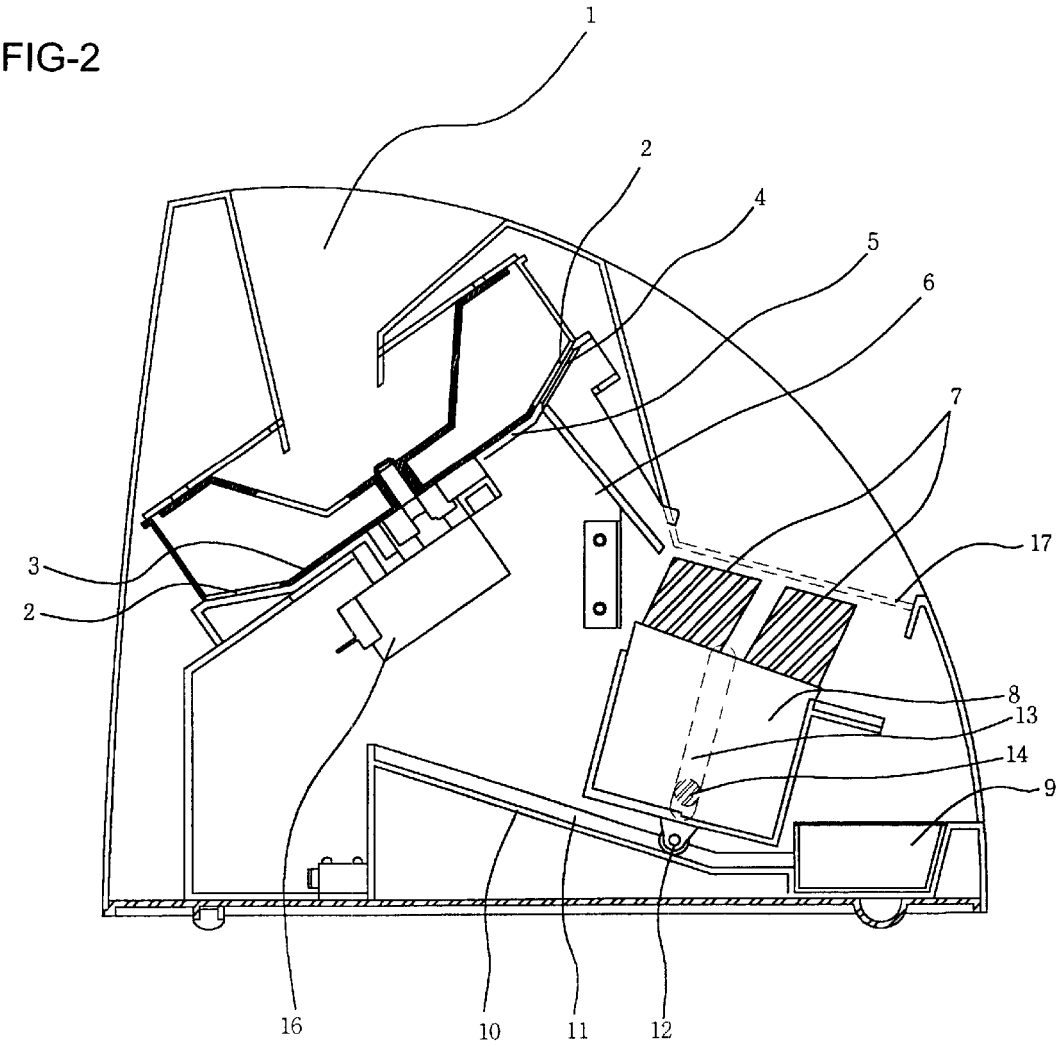
FIG. 2 is a schematic diagram of the present device.
Figure 3:
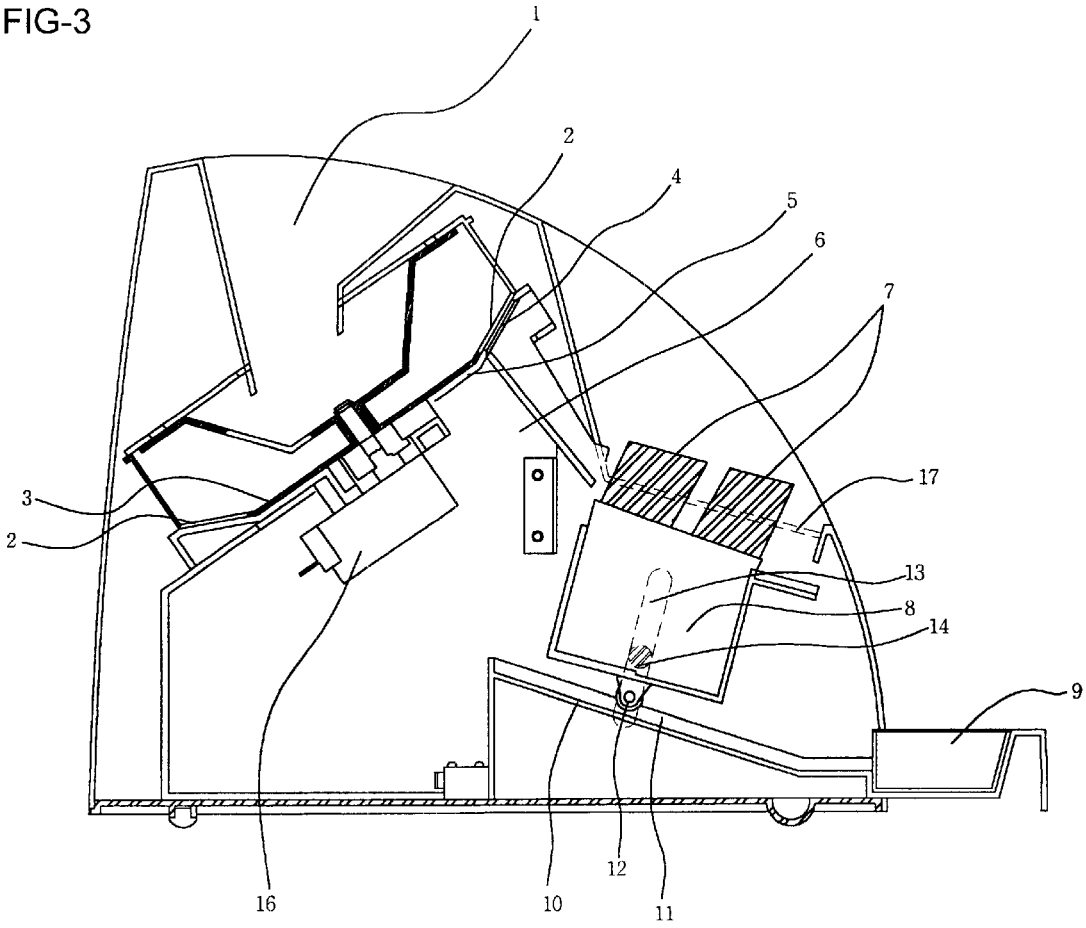
FIG. 3 is an operational diagram of the present device.
Figure 4:
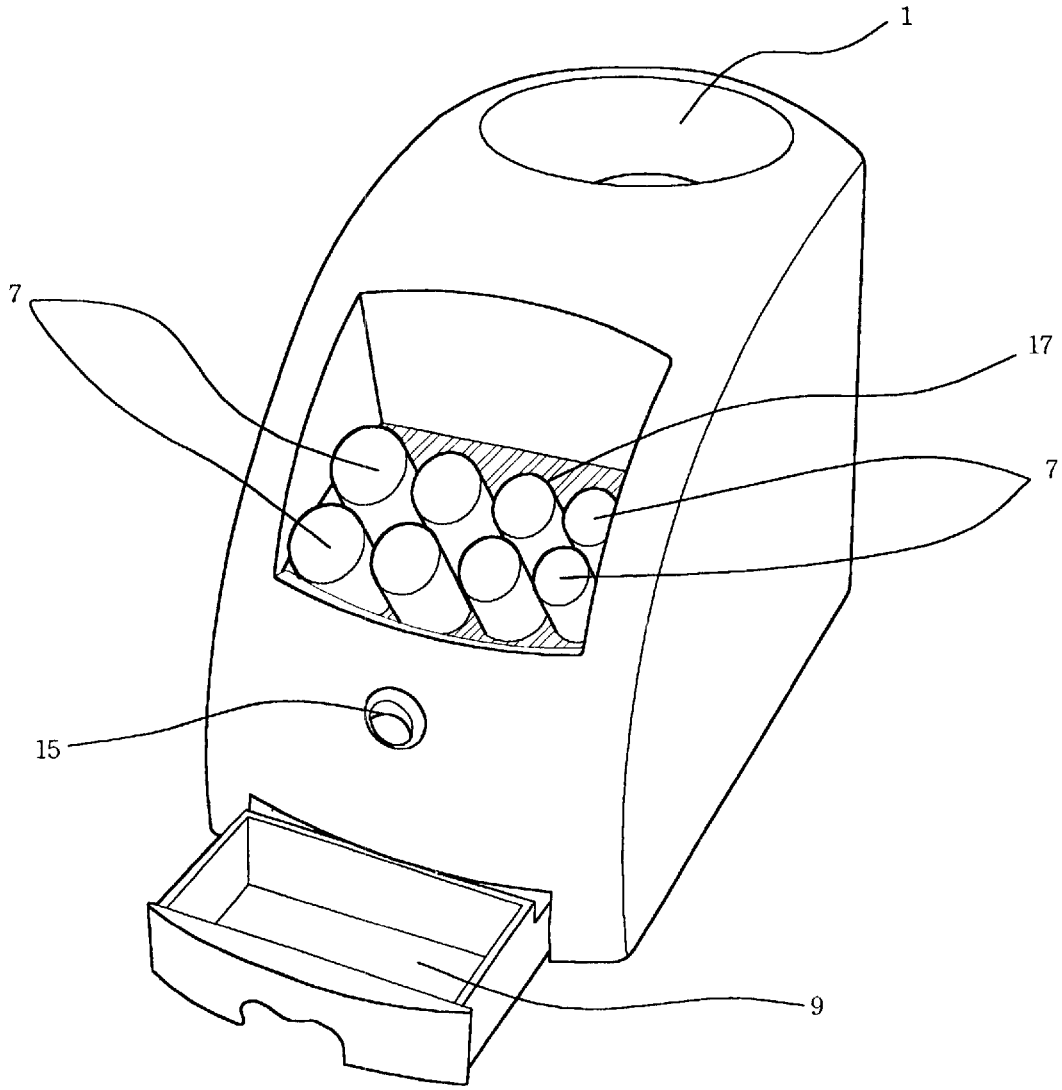
FIG. 4 is an external view of the present device.

The following is the detailed explanation of the present device, with the drawing FIGS. 2–4 and its working practice as reference.

As illustrated in FIGS. 2–4, the fallen-coin drawer 9 installed at the lower part of the coin separator is a slide-type one which slides in and out. At its rear part is built the sloping structure 10 that rises gradually along the direction of the rear part. And at the upper part of the above sloping structure 10 is built one or more rail (s) 11 in the direction of the length.

The receipt vessel 8 on which the coin receipt tube 7 is mounted is so constructed that its roller built at its lower part is laid on the rail(s) 11 of the sloping structure 10. If the fallen-coin drawer 9 is opened, the sloping structure 10 moves toward the direction in which the above fallen-coin drawer 9 is opened, the slanting part of the sloping structure 10 makes the receipt vessel 8 move upward, and the coin receipt tube 7 mounted on the receipt vessel 8 moves together in the same upward direction. As a result, the coin receipt tube 7 is projected out of the coin separator, so that the withdrawal of the above coin receipt tube 7 is made easy. On the contrary, if the fallen-coin drawer 9 is shut, and the sloping structure 10 returns to its original position, the receipt vessel 8 moves downward and returns to its original position, and the coin receipt tune 7 mounted on the receipt vessel 8 also returns to its position and is accepted into the coin separator.

On the upper part of the coin receipt tube 7 is a shielding valve 17 that has a hole (not shown in the drawings) of the same size as the outside diameter of the coin receipt tube 7. When the receipt vessel 8 is pushed upward, the coin receipt tube 7 is seceded through the hole (not shown in the drawings) of the shielding valve 17, and so is easily mounted on or removed from the receipt vessel 8.

A groove 13 is built in the direction of the height on the inside wall of the coin separator that holds the receipt vessel 8, and a protrusion 14 built on the receipt vessel 8 is inserted into the above groove, so that the up and down movement of the above receipt vessel may be stably performed.

The operation of the present device is explained in detail in the following, with its working example as reference:

If coins to be sorted are put into the carrier vessel 3 through the input opening 1 and the switch 15 is turned on, the motor 16 rotates the carrier vessel 3, and the coins are loaded onto coin carrier holes in the above vessel 3. Then the coins are carried to the coin separation holes 4 in the coin separation valve 5, and each coin makes a free fall at a separation hole 4 of the same diameter as its own. Each coin sorted and separated at the coin separation valve 5 is received, via its relevant movement passage 6, by the coin receipt tube 7 the inside diameter of which is the same as the diameter of the coin. As for coins overflowing the above coin receipt tube 7, they fall and gather in the fallen-coin vessel 9.

If the fallen-coin drawer 9 is pulled open when the coin sorting operation is finished or the coin receipt tube 7 is filled with coins, the sloping structure 10 at the rear part of the fallen-coin drawer 9 moves out, the receipt vessel 8 is pushed upward at the same time, and the coin receipt tube 7 is projected out of the shielding valve 17. The projected coin receipt tube 7 is taken out, and received coins are collected. Then the coin receipt tube 7 is mounted again on the receipt vessel 8. Also, when the fallen-coin drawer 9 is pushed shut after coins that gathered in the fallen-coin drawer 9 are collected, the sloping structure 10 is pushed into the inside, and the receipt vessel 8 moves down at the same time. Thus the operation of the coin separation can be continued again.

As for the coin separator according to the present device, in case that the fallen-coin drawer is opened, the receipt vessel is pushed upward and the coin receipt tube is automatically drawn out of the coin separator. Thus the coin receipt tube can be easily mounted on or be removed from the receipt vessel, which makes it easy to collect coins that were received in the above receipt tube.

What is claimed is:

1. A withdrawal apparatus of a coin receipt tube for a coin separator, comprising:

said coin receipt tube;

a fallen-coin drawer having a horizontal movement direction; and a sloping structure having a sloping upper surface, wherein:

said coin receipt rube has a roller at a tower portion;

said sloping structure is positioned below said coin receipt tube and includes a rail on said sloping upper surface, said rail mounted parallel to a drawer-movement direction; and said fallen-coin drawer is integral with a front portion of said sloping structure.

2. A withdrawal apparatus of a coin receipt tube for a coin separator according to claim 1, wherein said rail is positioned to contact and guide said roller.

3. A withdrawal apparatus of a coin receipt tube for a coin separator according to claim 1, wherein said withdrawal apparatus comprises plural coin receipt tubes.

* * * * *